US006182335B1

(12) United States Patent
Juda et al.

(10) Patent No.: US 6,182,335 B1
(45) Date of Patent: Feb. 6, 2001

(54) CLOTHING PROTECTIVE DEVICE

(75) Inventors: Daniel P. Juda, New York; Edward Sullivan, Huntington Station, both of NY (US)

(73) Assignee: Idego, Inc., New York, NY (US)

( * ) Notice: Under 35 U.S.C. 154(b), the term of this patent shall be extended for 0 days.

(21) Appl. No.: 09/225,807

(22) Filed: Jan. 5, 1999

Related U.S. Application Data

(60) Provisional application No. 60/070,581, filed on Jan. 6, 1998.

(51) Int. Cl.[7] ..... A41D 25/04; F16G 11/00

(52) U.S. Cl. ..... 24/7; 24/9; 24/66.9; 24/115 H

(58) Field of Search ..... 24/7, 8, 9, 181, 24/115 H, 66.9, 66.1

(56) References Cited

U.S. PATENT DOCUMENTS

| | | | | |
|---|---|---|---|---|
| 324,039 | * | 8/1885 | Nelson | 24/9 |
| 598,870 | * | 2/1898 | Hoagland et al. | 24/7 |
| 1,669,983 | * | 5/1928 | Humphrey | 24/9 |
| 1,725,748 | * | 8/1929 | Alexander | 24/115 H |
| 2,861,313 | * | 11/1958 | Ruf | 24/115 H |
| 3,453,698 | * | 7/1969 | Mosby | 24/66.9 |
| 3,813,737 | * | 6/1974 | Larsen | 24/66.9 |
| 4,425,680 | | 1/1984 | Basseches et al. . | |
| 4,587,692 | | 5/1986 | Kaderabek . | |
| 4,953,809 | * | 9/1990 | Barrus | 242/107.3 |
| 5,008,981 | * | 4/1991 | Smithson | 24/66.9 |
| 5,191,681 | | 3/1993 | Lokken . | |
| 5,509,616 | * | 4/1996 | Millen, Jr. et al. | 242/381.5 |

* cited by examiner

*Primary Examiner*—Victor N. Sakran
(74) *Attorney, Agent, or Firm*—Scully, Scott, Murphy & Presser

(57) ABSTRACT

A clothing protective device which is particularly adapted to be worn by a person, such as a man, woman or child, and which in particular will assist in the protection of clothing while dining. In essence, the device is essentially in the form of a so-called napkin holder which can be readily transported in a clothing pocket or a purse and which is imparted a large number of uses in addition to being merely a clothing protective device.

10 Claims, 4 Drawing Sheets

CLOTHING PROTECTIVE DEVICE

CROSS-REFERENCE TO RELATED APPLICATIONS

This application claims the benefit of the U.S. Provisional Patent Application No. 60/070,581; filed on Jan. 6, 1998.

BACKGROUND OF THE INVENTION

1. Field of the Invention

The present invention relates to a clothing protective device which is particularly adapted to be worn by a person, such as a man, woman or child, and which in particular will assist in the protection of clothing while dining. In essence, the device is essentially in the form of a so-called napkin holder which can be readily transported in a clothing pocket or a purse and which is imparted a large number of uses in addition to being merely a clothing protective device.

In essence, various types of clothing protective devices, especially in the form of napkin holders which may be worn about the neck of the user during dining are currently known and in widespread use. Among such devices, of a rather primitive nature are the so-called napkins or bibs which are adapted to be tied about the neck of a wearer during dining and which are relatively unsightly when worn in public locations or more sophisticated dining establishments.

Currently a number of clothing protective devices of this nature; in essence, which are adapted to be worn about the neck of a wearer during desired periods of time; for example, such as when dining or the like, are known in the art.

2. Discussion of the Prior Art

Among the devices adapted to protect clothing during dining or similar instances are the napkin clip of Basseches et al. U.S. Pat. No. 4,425,680. In that instance, a clip which may be attached to an upper clothing portion below the chin of a wearer has clamping structures which are adapted to engage a napkin corner which is passed through a slot so as to be clipped to the clothing. This, however only protects a narrow front portion of the clothing of the wearer and, in essence, does not provide for any adjustability with regard to the different types of clothing, or the size of the wearer; for example, that of a man compared to woman or a child. Consequently, Basseches at el. discloses a napkin clip which is only of relatively limited applicability.

Lokken U.S. Pat. No. 5,191,681 discloses a napkin or drape holder which is in the form of a spring-like first plastic member and a spring-like second plastic member of collinear proportion adapted to be engaged so as to wedge a hinge structure therebetween, the latter of which may be attached to a napkin or a drape. When attached to a napkin, the ring-like element may be positioned about the neck of wearer during dining. This however, presents, a complex and uncomfortable structure which is not suspectable of large scale utilization in view of its lack of adjustability to the neck of a child or woman where it may create problems as to sensitivity and discomfort.

Similarly, Kaderabek U.S. Pat. No. 4,587,692 discloses a universal napkin support in the form of two elastic circular arm bands which are adapted to be position about the neck of a wearer, and wherein clip members at side portions thereof are adapted to engage a clothing or napkin article so as to be suspended from the neck of the wearer. Again, as in the previously discussed patent to Lokken, this would provide a large degree of discomfort and lack of adjustability for the neck of a woman or child of tender years.

SUMMARY OF THE INVENTION

Accordingly, in order to clearly and advantageously distinguish over the foregoing, pursuant to the present invention a clothing protective device includes a small case, generally in the form of a cylindrical element, constituted of two separable halves attached by an extendable and subsequently retractable string, and incorporates elements for the attachment of a clothing protective article to the device, such as a napkin or the like.

The item aids in the protection of clothing while dining, the small casing assembly allows the user to keep a variety of items which are helpful before, during and after meals in one convenient case. The outer case can be made of any type of material, i.e. wood, plastic, metal, glass and is easily transported in a clothing pocket or purse. The two halves of the symmetric container split apart to expose an individual clip on the innermost planar surface of each half. The clips hold a user supplied napkin in place during a meal or while engaging in activities which would normally stain clothing. The two halves of the case are connected by means of a retractable string which is draped around the neck of the user, who attaches each clip to one side of a napkin which can then be easily adjusted to vary the napkin position. When finished dining the two halves are simply unclipped by the user from the napkin, and by applying a slight pressure to a release button, located on an internal planar surface of the bottom half, retracts the string into that half of the casing. The remaining few inches of string, which is left outside of the container, are automatically retracted and concealed when the two halves are placed together. Furthermore, the user need not press the release button to retract the string, but by merely bringing the two halves of the case together and closing them, causes an internal retraction mechanism to roll up the string and conceal it within the reassembled halves of the case. A pair of steel locating pins is adapted to keep the assembly consisting of the case halves together, oriented and magnetically attached until pulled apart again.

In addition to constituting a basic clothing protective device, the entire unit consisting of the case and the attended napkin engaging structure and mechanism is also adapted for other diverse application, all of which enhance the usefulness and aesthetic value thereof.

The unit may also be worn as a necklace by removing the internally stored decorative chain and clipping it to the outside of the unit in the spaced provided. The internal components that make up the mechanical sub-assembly are designed into the bottom half and in a fashion that can be easily inserted into a variety of external cases that can be both entertaining as well as decorative. The variety of material that can be used in manufacturing can vary how it is sold and help to classify it as either as a novelty, toy or jewelry either expensive or costume in structure. Components which do not relate to the function of the string retraction sub-assembly mechanism but make up the rest of the unit as a whole may comprise, selectively, a toothpick, mirror and recessed photograph or engraving. The top half of the container, which does not house the string retraction mechanism, is used for storage of a toothpick and necklace. The extreme outer spherical surface of both halves, of this particular design, are flat and parallel to each internal surface and can provide a smooth face for engraving in the event a recess for the picture or mirror is not desired for other models. The toothpick, concealed in a recess on the circumference of the outermost spherical portion of the top half, can be easily removed by inserting a finger tip into the concave indentation and pulled outward.

Accordingly, it is an object of the present invention to provide a novel clothing protective device comprising a casing including separable halves interconnected by an extendable and retractable string which includes clip structure for engaging a napkin or similar clothing protective article.

Another object of the present invention is to provide a casing consisting of mating casing halves which are adapted to be carried in a clothing pocket or a purse, and which may be readily removed therefrom and placed about the neck of the wearer by being separated while attached by an extendable string so as to engage a clothing protective article, such as a napkin, while the user is dining.

Yet another object of the present invention is to provide a clothing protective device of the type described herein which includes retraction mechanism subsequent to use thereof when worn about the neck of a wearer so as to be able to reassemble the casing halves with the string retracted therein.

A still further object to present invention is to provide a clothing protective device as described herein wherein the device is adapted to selectively incorporate further features, such as the incorporation of a toothpick, mirror, neck chain and other elements in enhancing the usefulness and aesthetic properties thereof.

BRIEF DESCRIPTION OF THE DRAWINGS

Reference may now be had to the following detailed description of preferred embodiments of the invention, taken in conjunction with the accompanying drawings; in which.

DETAILED DESCRIPTION OF PREFERRED EMBODIMENTS

Figure 1:
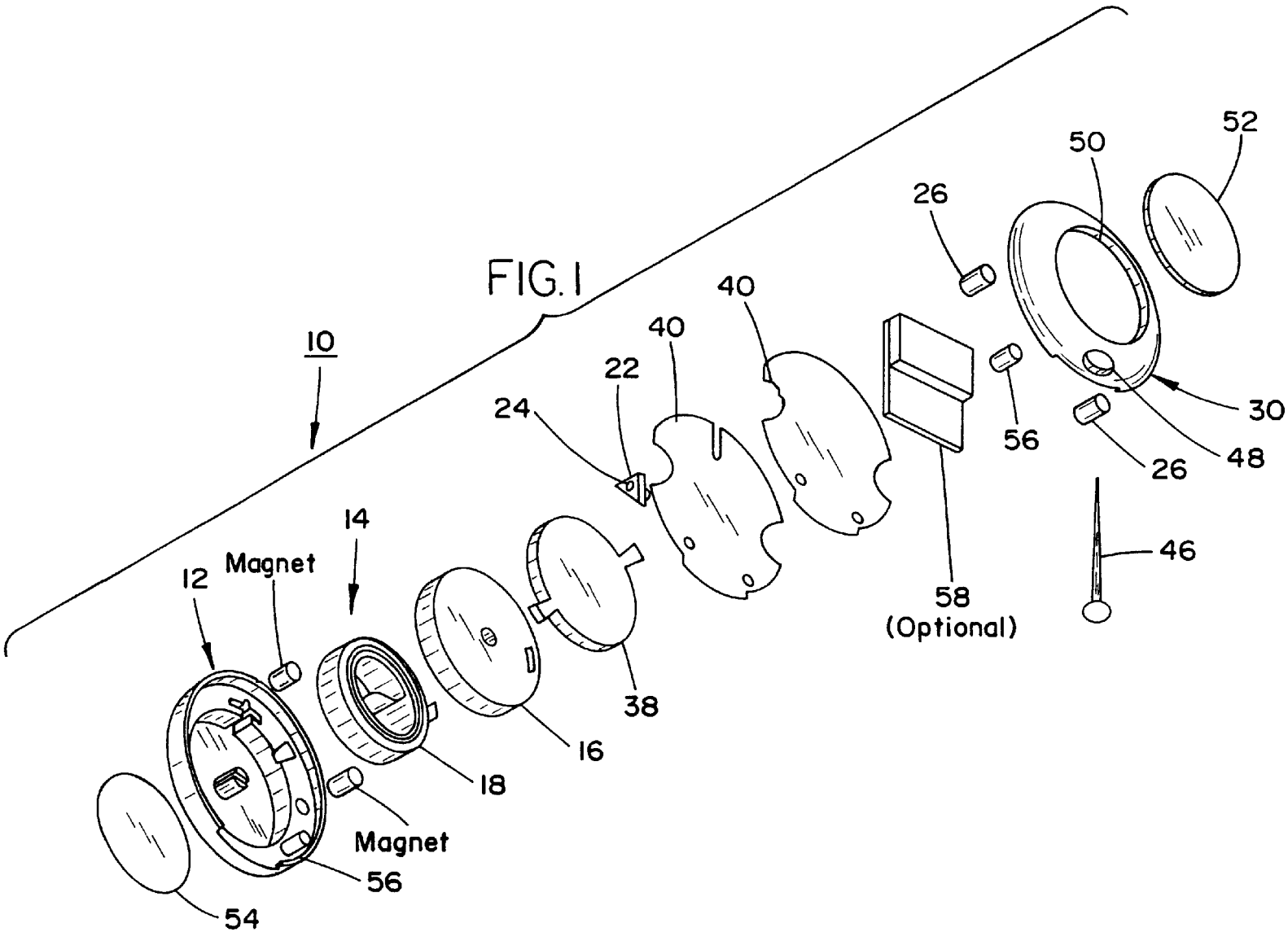
FIG. 1 illustrates an exploded perspective view of the clothing protective device pursuant to the invention, illustrating all of the internal constituents thereof.

Reference may now be had to FIG. 1 of the drawing which illustrates a perspective exploded view of the clothing protective device 10 with essentially all of the internal components, including optional components, being shown in the order in which they would be installed within the clothing protective device 10.

Referring specifically to the detail of components, the clothing protective device 10 includes a first hollow cup member forming a lower case half 12. This cup-shaped component houses the string retraction mechanism 14, consisting essentially of a spool 16, a coil spring 18, a connecting string 20 (shown in FIG. 5), a trip latch 22, a trip latch pivot pin 24, a pair of steel locating pins 26, and a spool retainer 28.

As illustrated, the mating case half 30 also is essentially hollowed cup-shaped and is adapted to house a toothpick 32, a mirror 34, and is provided with a hollow or recess on an opposite side, which is adapted for storage of a necklace chain or other small items (not shown) which may adapt the entire device to be worn as a decorative pendant or the like. As is indicated, the spool 16 is adapted to retain the string 20, the latter of which may by formed of Kevlar™ or the like to impart strength thereto and resistance to tearing, while stored in the cup-shaped casing half 12. The coil spring 18 is a coiled taut spring which is adapted to supply the force needed to retract and wind the string 30 when the casing halves are placed together onto the spool 16. The spring also supplies the force which is required to lock the trip latch 22.

A spool retainer 38 forms a protective barrier between the spool 16 and a napkin clip 40 for the casing half 12. The spool retainer 38 also serves as a spacer in order to retain the spool 16, thereby restricting the vertical movement thereof relative to the case.

Figure 2A:
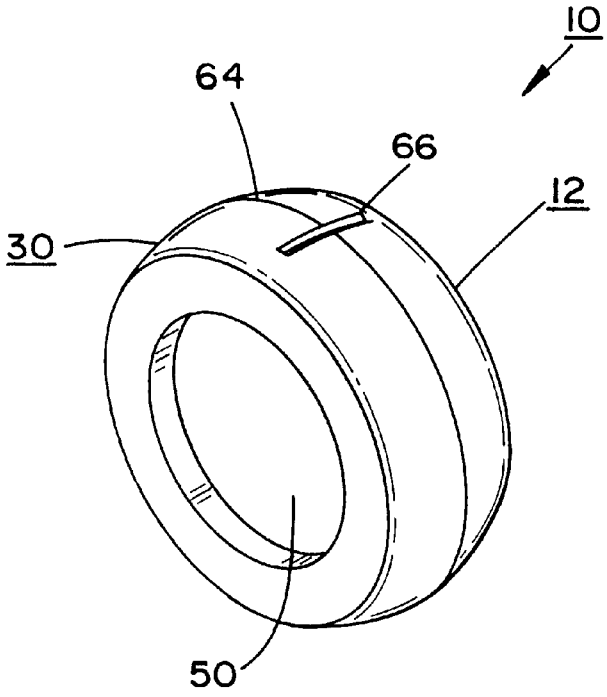
FIGS. 2*a* and 2*b* illustrate, respectively, a front and top view and a rear and bottom view in a perspective representation of the assembled clothing protective device, shown on an enlarged scale.
Figure 2B:
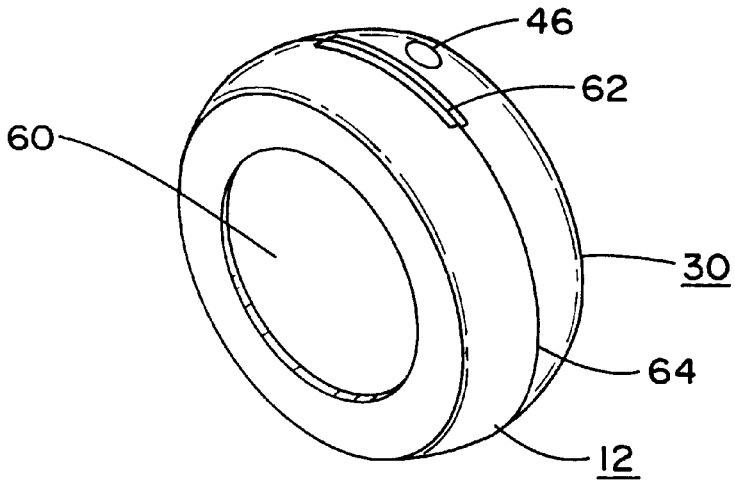
Figure 3A:
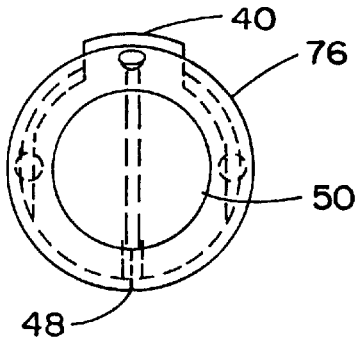
FIGS. 3*a* through 3*d* illustrate, respectively, top, bottom, front and rear views of the assembled casing halves forming the clothing protective device pursuant to the invention.
Figure 3C:
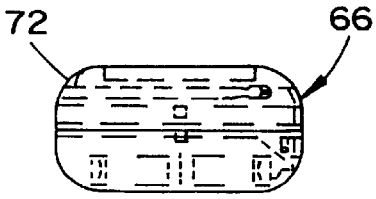
Figure 3D:
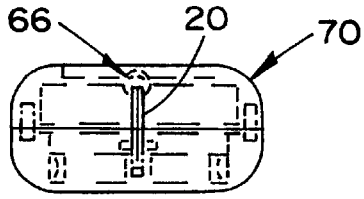
Figure 3B:
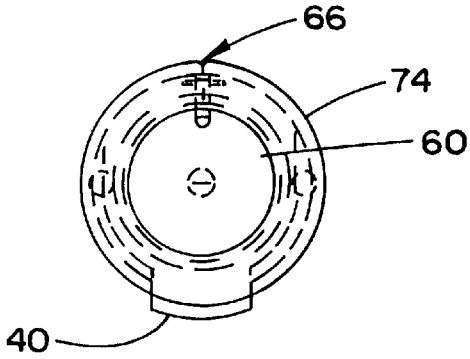
Figure 4:
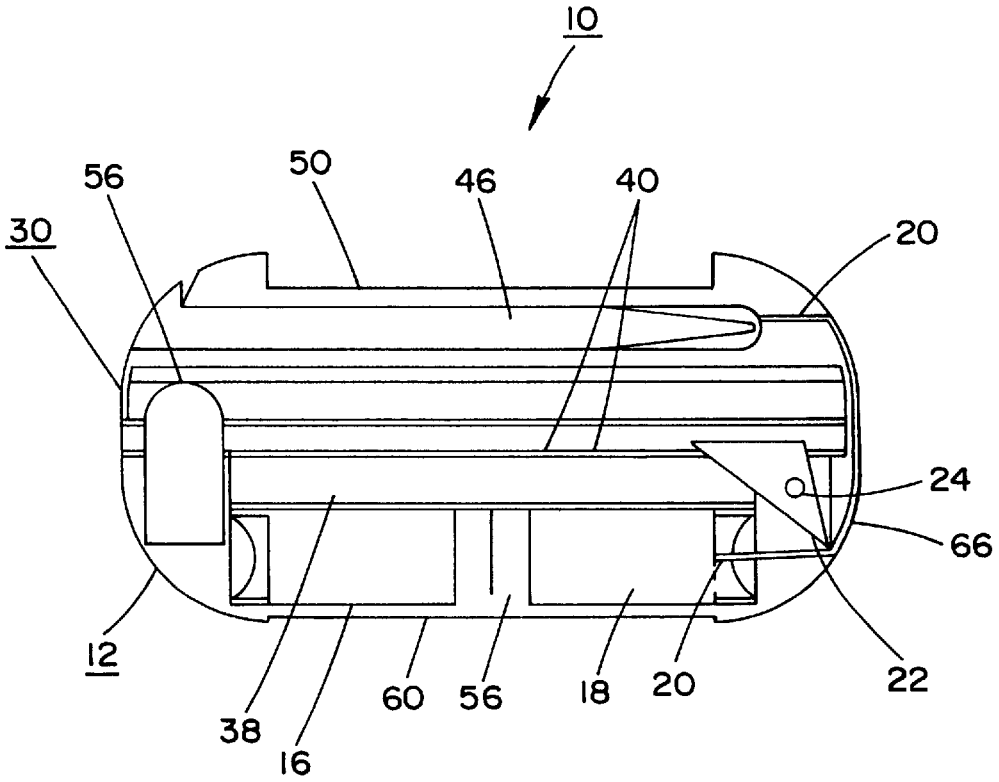
FIGS. 4 illustrates, on an enlarged scale, a transverse central sectional view of the device of FIG. 3*a*.

As illustrated, two napkin clips 40 and 42 are provided to serve as fasteners for the inserted napkin (not shown). The steel locating pins 26 are employed as a guide structure during the matings or placing together of the cup halves 12 and 30, when the latter are in the closed positions as shown in FIGS. 2*a* and 2*b*, and FIG. 4 of the drawings. In order to maintain the mating case halves 12 and 30 together, suitable magnets 44 are provided as illustrated in FIG. 1 of the drawing. The trip latch 22 provides for the locking mechanism for the string 20, whereas the pivot pin 24 for the trip latch provides a pivot point during the locking and releasing of string 20.

Further provided may be a suitable toothpick 46 which is adapted to slide into a recess 48 formed in the casing half 30.

The casing half 30 may have the outer service provided with a circular recess 50 for receiving a mirror 52; whereas similarly, the bottom of the casing half 12 may have a circular picture or metal engraving structure 54 inserted therein and fastened thereto through a suitable adhesive. Further provided is a napkin plug 56 which engages adjacent the casing half 30, and which may provide a so-called "squeeze point" for the napkin which is to be held by the device 10 and the napkin clip 40.

An optional component which may be incorporated into the unit may be a suitable circuit board or digital display for additional function, in future models, as described hereinbelow.

In FIGS. 2*a* and 2*b* there are illustrated two enlarged perspective views of the complete device 10. The rear and bottom view in FIG. 2*b* shows the picture recess 60 in case half 12, the inserted toothpick 46 and the access slot 62 for the napkin fastener. The cup-like case half 12 contains all of the mechanical components which are described in specific detail with reference to FIG. 4, and as shown in FIG. 1. The case half 3 contains toothpick 46, a storage compartment and one-half of the slot 62. This slot allows for access to the napkin clip 40 so that a user can bend the clip outwardly with one finger and allow for the insertion of the napkin. A match line 64 represents the mating halves of the two major case components 12 and 30 when the assembly of the device is complete. The front and top view, FIG. 2*a*, shows the mirror recess 50 in case half 30, a recessed string slot 66, the case half 12 and the assembly match line 64.

FIGS. 3*a* through 3*d* illustrate four views of the complete assembled device 10. A frontal view 70 depicts the string slot/recess 66 which is provided for easier retraction of the string 20 upon closure of the device. Side view 72 diagrammatically displays the complete internal workings of the device 10, which view 74 shows the external and internal features of the bottom case half 12 only so as not to confuse them with the mating upper case 30 shown by view 76. The coil spring 18 (in FIG. 1) is not shown for purposes of clarity, but is contained within spool 16. The lower half, view 74 displays the recess 60 for a picture or engraving 54 which could be added for decorative purposes. The upper view 76, shows the external and internal features of the top half case only so as not to confuse them with the mating lower half case, whereas view 76 displays the recess 50 for a mirror 52 and the channel 48 for recessing the toothpick 40, but not the necklace storage compartment.

FIG. 4 shown an enlarged transverse center section viewed from the left front side. Shown are the lower (bottom) and upper case halves 12, 30 of the protective clothing device assembly, respectively. Identified by reference numeral 40 are the napkin clips, preferably of polypropylene, which fold outwardly to allow for the insertion of one half of a napkin. When released, the clip 40 squeezes the napkin material between itself and the vertical pin 56. Also shown is the mirror recess 50 for mirror 52 in FIG. 1. The toothpick 40 is a nylon toothpick inserted into the channel or recess 48 (see FIG. 1.) Napkin clip 40 presses against trip latch 22 at closure so as to open the latter, and allows the string 20 (shown in FIG. 5) to retract into the device by means of preloaded "spring wound" spool 16. The string 20 is allowed to travel in and out of the device 10 via a narrow corridor from the inside to the outside of lower case half 12. The trip latch 22 is positioned above the string 20 in this corridor and toggles about pivot pin 24 is an "arc like" motion, but for only over a fraction of a degree. The string 20 is in constant contact with trip latch 22 in either direction of movement. As the string 20 moves outwardly, trip latch 22 toggles upwardly allowing the string 20 to pass unobstructed. As the string retracts inwardly, trip latch 22 toggles downwardly and squeezes the string against the base of the corridor, causing the string to lock, wherein 66 is the recess for the Kevlar string which connects both case halves 12,30 of the device 10. The recess 60 for a picture or engraving for decorative purposes, and recess 50 for a mirror may be eliminated if not required for other variations of the device. A center post 80 centers the spool 16, and more importantly retains the coil spring 18 center tab from releasing during extension or retraction of string 20. The spool retainer 38 is used as a spacer between the spool 16 and the underside of the napkin clip 40.

Figure 5:
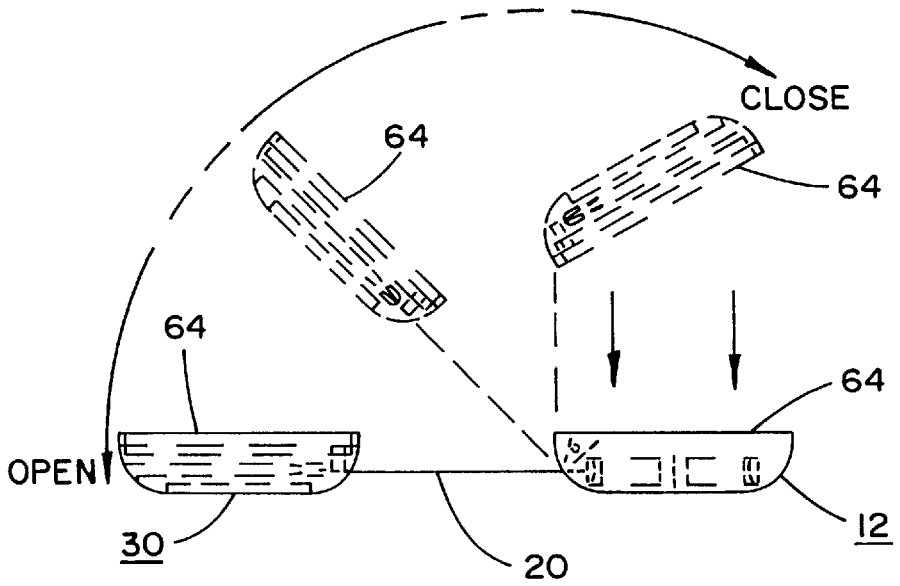
FIG. 5 illustrates the casing halves of the device shown in various operative positions thereof.

Referring to FIG. 5, the device 10 is represented diagrammatically in a simulated motion during closure of the case halves 12 and 30. The string 20 is preferably a 40" long Kevlar™ string which joins the two case halves 12 and 30, and serves as a hanger when wrapped around the neck of a user and retracts into the lower casing 12 for storage. The opposite end of string 20 is attached to the upper casing half 30, and is secured through the toothpick recess 48.

Modifications of the above described inventive clothing protective device 10 may incorporate an LED (light emitting diode) display behind the mirror 52, which will cause a light to shine through the mirror when a button is depressed or if the device is squeezed by user. This display can be employed for time, alarm clock settings, or a variety of reminder messages. Furthermore, the device could also be employed as a pocket pager to indicate the phone numbers of incoming calls and as a cellular phone when the electronic technology enables such electronics to be incorporated into a subminiature package the size of the present device 10. For that purpose, the circuit board and digital display referred to hereinabove under reference numeral 58 is an optional element which is normally not installed in the present device, until the latter is adapted to be modified for the above-referenced electronic utilization.

While there have been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A clothing protective device positionable so as to be worn about the neck of a wearer and for clampingly engaging a clothing protective article covering portions of the clothing; said device comprising:

a) a casing structure having first and second mating halves consisting of first and second hollow cylindrical cup-shaped members which are manually separable;

b) a string member interconnecting said first and second casing halves to enable said casing structure to be suspended from the neck of a wearer upon separation of said first and second casing halves; and c) first and second clip means on respectively each of said first and second casing halves clampingly releasably engaging said clothing protective article when said separated first and second casing halves are suspended from the neck of the wearer, said hollow cylindrical cup-shaped members upon release of said clip means from the clothing protecting article being positionable in mating contact against each after during periods of non-use to form a closed hollow cylindrical housing.

2. A device as claimed in claim 1, wherein said first casing half houses operative mechanism for the outward extension of said connecting string member upon separation of said casing halves and for the retraction of said string member into said first casing half at the closing together of said casing halves.

3. A device as claimed in claim 2, wherein said operative mechanism comprises a spool in said first casing half for winding said string member thereabout upon being retracted into said casing half; and trip latch structure for releasably latching said string member in predetermined extended positions thereof upon separation of said casing halves.

4. A device as claimed in claim 3, wherein said operative mechanism comprises a helical coil spring operatively connected to said winding spool and trip latch for said string member for retracting said string member into said first casing half upon said casing halves being assembled into a closed position.

5. A device as claimed in claim 1, wherein pins are provided for aligning said casing halves in the assembled position thereof.

6. A device as claimed in claim 5, wherein magnets are provided for attracting said casing halves to each other in the assembled position thereof so as to form a closed housing.

7. A device as claimed in claim 1, wherein said second casing half includes a recess for the receipt and storage of a removable toothpick.

8. A device as claimed in claim 1, wherein one of said casing halves includes a recessed outer surface for mounting a decorative mirror.

9. A device as claimed in claim 8, wherein the other of said casing halves includes an outer recessed surface for mounting a picture or having a decorative engraving formed therein.

10. A device as claimed in claim 1, wherein said first and second casing halves are selected from the group of materials consisting of metal, plastic or wood.

* * * * *